United States Patent [19]

Mulder et al.

[11] Patent Number: 4,561,380

[45] Date of Patent: Dec. 31, 1985

[54] METHOD AND APPARATUS FOR POWDER COATING A MOVING WEB

[75] Inventors: Douglas C. Mulder, Wellington; David E. O'Ryan, Avon Lake, both of Ohio

[73] Assignee: Nordson Corporation, Amherst, Ohio 44001

[21] Appl. No.: 622,963

[22] Filed: Jun. 21, 1984

[51] Int. Cl.[4] ..... B05B 7/06; B05B 7/14

[52] U.S. Cl. ..... 118/688; 118/690; 118/308; 118/311; 118/312; 118/326; 239/434.5; 239/518; 239/524; 239/DIG. 3; 239/DIG. 7

[58] Field of Search ..... 118/308, 311, 312, 326, 118/325, 688, 689, 690; 239/434.5, 71, DIG. 3, DIG. 7, 518, 524; 324/452, 454

[56] References Cited

U.S. PATENT DOCUMENTS

| | | | |
|---|---|---|---|
| 2,929,436 | 3/1960 | Hampshire | 118/308 X |
| 2,964,419 | 12/1960 | Link et al. | 118/311 X |
| 3,010,766 | 11/1961 | Coski | 406/144 X |
| 3,746,254 | 7/1973 | Duncan et al. | 239/15 |
| 4,018,185 | 4/1977 | Myers | 118/308 |
| 4,044,175 | 8/1977 | Coxon et al. | 118/310 |
| 4,144,538 | 3/1979 | Chapman et al. | 118/308 |
| 4,199,281 | 4/1980 | Wolf | 406/93 |
| 4,212,266 | 7/1980 | Payne et al. | 118/308 X |
| 4,245,551 | 1/1981 | Berkmann | 98/115 SB |
| 4,277,260 | 7/1981 | Browning | 55/273 |
| 4,357,900 | 11/1982 | Buschor | 427/185 |
| 4,430,886 | 2/1984 | Rood | 239/71 X |
| 4,473,428 | 9/1984 | Buck et al. | 118/312 X |

OTHER PUBLICATIONS

Vortec Advertisement ©, "Transvector Air Flow Amplifier".

*Primary Examiner*—Shrive P. Beck

*Attorney, Agent, or Firm*—Wood, Herron & Evans

[57] ABSTRACT

A method and apparatus is disclosed, in the presently preferred embodiment, for applying powdered adhesive to non-woven fabric material. The apparatus includes a novel powder spray gun wherein there is an air flow amplifier contained within the gun for accelerating the velocity of powder emitted from the gun and sprayed onto the top of a conveyorized web of the fabric material. The apparatus also includes a novel system for supplying powder to the spray gun, which system includes a first powder pump, a back-up pump and a control circuit responsive to detection of reduced powder flow to the gun to switch supply from the first pump to the back-up pump.

31 Claims, 5 Drawing Figures

METHOD AND APPARATUS FOR POWDER COATING A MOVING WEB

This invention, in the presently preferred embodiment, relates to the spraying of solid particulate powder material, and more particularly to an improved method and apparatus for spraying solid particulate powder adhesive material onto non-woven fabric materials.

Non-woven fabrics have traditionally been manufactured by spraying a liquid adhesive onto a wide web of loose fibers and then passing that liquid adhesive containing web of loose fibers through compression rollers so as to compress the web and adhesively secure the fibers to one another. Quite commonly, the webs of loose fibers are ¼ to 1 inch in thickness when the adhesive is applied and, after compression, are approximately 0.005–0.060, inch in thickness.

A very desirable characteristic of non-woven fabrics is that they have a soft fluffy feel as well as a high tensile strength. Generally though, the greater the tensile strength of the materials, the greater is the quantity of adhesive required to impart that tensile strength and the less is the softness or fluffiness of the resulting fabric. In other words, the softness or fluffiness of the non-woven fabric is inversely proportional to the quantity of liquid adhesive applied and the resulting tensile strength of the fabric. In part, this characteristic is attributable to the fact that in order to obtain good tensile strength of the fabric it is necessary to thoroughly penetrate the web of loose fibers with adhesive. Consequently, the web must be thoroughly wetted with a substantial quantity of adhesive in order to impart good tensile strength but in the process the softness or fluffiness of the resulting fabric is impaired.

In an effort to obtain a soft or fluffy non-woven fabric with relatively high tensile strength, efforts have been made to substitute powdered adhesive for the liquid adhesive which has heretofore been traditionally used to bond the fibers of the non-woven fabric. One such attempt involved metering powdered adhesive through a slotted hopper in which the powder was distributed via a rotating auger. The resulting powder containing non-woven fiber web was then heated to melt the adhesive powder so as to impart tackiness to the powder. The web then passed through rollers to compress the web and adhere the fibers into a non-woven fabric. In general, this slotted spreader was unsatisfactory for most applications because it did not evenly distribute the powder over the surface of the non-woven fiber mat and it was incapable of supplying very low quantities of powder evenly distributed over a large area. In many applications as little as 1–12 grams per square meter of powdered adhesive is required to be evenly distributed over the surface of the non-woven web fabric. Additionally, powder from this auger fed slotted spreader did not penetrate the web sufficiently to achieve good tensile strength in the resulting fabric when the powdered adhesive was subsequently melted and the web passed through compression rollers.

Another attempt at substituting powdered adhesive for the liquid adhesive heretofore utilized in bonding the fibers of a non-woven fabric involved application of the powder to the surface of a rotating roller from which the powder was dispersed by application of an electrical charge to the surface of the roller. The electrical charge on the roller repelled the powder so as to cause it to move off of the roller onto the surface of the non-woven fiber web passing beneath the roller. This approach was also found to be unsatisfactory because it did not result in an even distribution of relatively small quantities of powder over a large area, i.e., 1–12 grams of powder per square meter evenly distributed over the surface of the non-woven fiber web. Furthermore, the use of an electrical charge to disperse powder from a rotating roller did not impart sufficient velocity to the powder to cause the powder to adequately penetrate the web of non-woven fibers. As a result, the resulting non-woven fabric did not have the desired tensile strength.

It has therefore been an objective of this invention to provide a new method and apparatus for applying adhesive to non-woven fabric which results in high tensile strength fabric but with a minimum sacrifice of softness or fluffiness of the resulting product.

This objective has been achieved and one aspect of this invention is predicated upon the concept of spraying a solid powdered adhesive onto the non-woven fiber web. But, the spraying of powdered adhesive onto the non-woven fiber web has required the development of new equipment for applying that powder because the only equipment heretofore available has been incapable of applying an evenly distributed pattern of powdered adhesive over a wide web, or of obtaining sufficient penetration of the powder into the non-woven fiber web.

It has therefore been another objective of this invention to provide a new apparatus for applying an evenly distributed pattern of powdered material to a wide web of loose non-woven fiber material while simultaneously obtaining substantial penetration of that web by the powder.

Powder spray guns are well known in the prior art but when conventional powder spray guns were initially employed for this application, it was found that the guns sprayed far too narrow a pattern and when multiple guns were utilized, the patterns sprayed by the guns tended to overlap and streak. As a result, there were hard spots in the resulting non-woven fabric. Additionally, the powder tended to lie on the top of the non-woven fiber web rather than to penetrate the web as is required in order to obtain a good tensile strength product. To that end it was another objective of this invention to provide a powder spray gun which would spray an evenly distributed wide pattern so as to enable a relatively wide web of base material to be evenly covered with adhesive and simultaneously impart sufficient velocity to the powder to obtain good powder penetration of the web.

The powder spray gun of this invention which overcomes both the distribution and the penetration problems described hereinabove utilizes an air amplifier at the input end of a powder spray gun. This amplifier is operative to impart a relatively high velocity to a stream of powder passing through the gun with the result that the powder adequately penetrates the web. Additionally, it was found that if such an air amplifier were utilized in combination with the gun, and if a large cone were placed adjacent the discharge end of the gun, the relatively high velocity powder emitted from the gun would be caused by the diverging surfaces of the cone to spread over a wide surface area while simultaneously obtaining an even distribution of relatively small quantities of powder over that wide area.

Another problem encountered was that the pattern of powder emitted from the gun tended to vary with time.

Whereas, a pattern might start out satisfactorily distributed over the surface of the fiber web, over a long period of time the pattern changed and began to streak. This problem was found to at least partially be attributable to the build-up of a tribocharge on the powder emitted from the gun. By utilizing a grounded metal, electrically conductive cone for dispersing the powder emitted from the gun, this build-up was avoided and the spray pattern remained consistent. Accordingly, in a preferred embodiment of the invention the complete powder spray gun utilized in the practice of this invention is manufactured from electrically conductive metal, and that metal is grounded.

The primary advantage of the invention of this application is that it enables a relatively small quantity of solid particulate powder material, as for example, 1–12 grams per square meter, to be applied to a wide web of non-woven fabric in an evenly distributed pattern and with sufficient powder velocity to obtain good powder penetration of the web. This invention also has the advantage of maintaining a good pattern of sprayed material over a prolonged period of time because of the elimination or reduction of the tribocharge on the powder emitted from the gun.

This powder spray gun also has the advantage of imparting sufficient velocity to the powder emitted from a powder spray gun so that the powder will penetrate air streams surrounding a web of material moving at a high velocity through the powder spray booth within which the gun is contained. In a preferred embodiment, this web moves at a speed of 0–1000 feet per minute with the result that there can be relatively strong air currents associated with that high speed moving web. In the absence of an air flow amplifier associated with the powder spray gun of this invention, the powder sprayed from the gun does not have sufficient velocity to penetrate these air currents or air streams with the result that the air streams disturb and ultimately upset the even distribution of powder emitted from the gun.

Still another aspect of this invention is concerned with the control of powder flow to the spray gun. A common characteristic of this powder is that it is often either transparent or matches the color of the web onto which it is sprayed. As a result, it is extremely difficult to determine visually if the quantity of powder sprayed onto the substrate has changed or if it has been completely interrupted. In the event of such a change or interruption, long runs of fabric web may pass through the adhesive applicator spray booth without any adhesive, or with too little adhesive, being applied with the result that a great deal of fabric becomes waste. To insure that interruption of flow of powder to the gun is immediately detected and corrected, the invention of this application incorporates a novel control system for supplying powder to the spray gun. This control system includes a back-up powder pump connected in parallel with each powder pump and a control circuit for immediately detecting and switching from a failed powder pump to a back-up pump in the event of a drop in powder flow to the gun. This control incorporates a transducer in the conduit which interconnects each powder pump to the gun. In the event that that transducer detects a reduced flow of powder to the gun, and that reduced flow falls below a preset threshold level, the control circuit automatically shuts down the first powder pump and substitutes the back-up powder pump in the system for supplying powder to the gun. If the substitution of the second powder pump into the system does not correct the condition, the control system is operative to automatically shut down the complete system as well as the conveyor for transporting the fabric web through the spray booth. Only upon correction of the powder flow condition to the gun will this control system permit the operation of the conveyor and the spray system.

These and other objects and advantages of this invention will be more readily apparent from the following description of the drawings in which.

Figure 1:
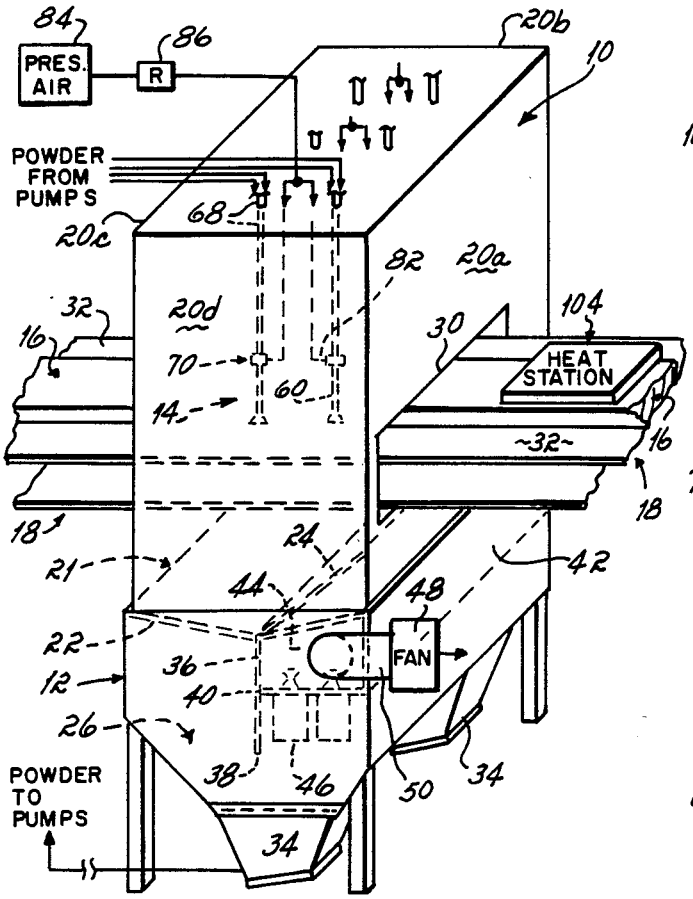
FIG. 1 is a perspective view of a powder spray booth incorporating the invention of this application.
Figure 2:
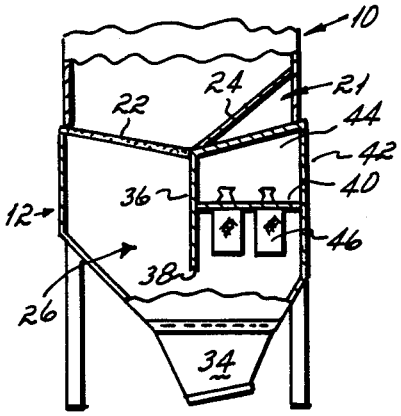
FIG. 2 is a cross sectional view through the lower portion of the booth illustrated in FIG. 1.

Referring first to FIGS. 1 and 2, it will be seen that the invention of this application is embodied in a powder spray booth 10 having a powder recovery system 12 mounted on the underside thereof. Within the booth, solid particulate powder material is sprayed from guns 14 onto the top of a web 16 of non-woven fabric material as that web passes through the booth upon the top of an endless conveyor 18. In a preferred embodiment, this conveyor is in the form of a continuous foraminous screen which transports the web through the booth at a velocity of 300–600 feet per minute.

The booth 10 comprises four side walls 20*a*, 20*b*, 20*c* and 20*d* and a bottom wall 21. The bottom wall 21 is divided into two sections 22, 24 which extend between opposite sides 20*b*, 20*d* of the booth. One section 24 is imperforate and slopes upwardly at an angle of approximately 30° from the center of the booth toward the side 20*a*. The other section 22 comprises a screen which extends between the sides 20*b*, 20*d* of the booth and which slopes upwardly at an angle of approximately 20° from the center of the booth toward the side 20*c*. Beneath the screen 22 is a powder recovery chamber 26 wherein oversprayed powder from the booth is collected after passing through the screen 22.

The conveyor 18 passes through openings 30 in opposed side walls 20*a*, 20*c* of this booth. These openings 30 are slightly larger in width than the width of the belt 32 of the conveyor 18 and extend vertically a distance slightly greater than the height of the conveyor. Consequently, there is an opening around the conveyor through which air may be pulled into the booth, as explained more fully hereinafter, to maintain oversprayed powder within the booth.

Oversprayed powder falls by gravity or is pulled by suction air flow from the interior of the booth 10 downwardly through and around the foraminous conveyor 18 through the screen 22, into the collection chamber 26. The collection chamber is divided into two sections by a vertical wall 36 which extends downwardly from the bottom wall of the booth 10. This wall terminates at a lower edge 38 spaced above the top of the collection hoppers 34. Additionally, there is a horizontal wall 40 which extends between the vertical wall 36 and a vertical outside wall 42 of the collection chamber. This horizontal wall 40 in conjunction with the vertical wall 36, the side wall 42 of the collection chamber, and bottom wall 24 of the booth define a clean air chamber 44.

There are openings in the horizontal wall 40 over which filters or filter cartridges 46 are mounted. A vacuum fan 48 is connected to the clean air chamber 44 via a conduit 50. The fan 48 is operable to pull air from the booth 10 downwardly through the conveyor 18, through the screens 22, and into the powder collection chamber 26. This air stream is pulled beneath the lower edge 38 of the vertical wall 36, upwardly through the filters 46, through the openings in the horizontal wall 40, into the clean air chamber 44 and subsequently through the conduit 50 to the fan 48. This air flow pulls oversprayed powder from the booth downwardly into the collection chamber where the majority of powder falls by gravity into the collection hoppers 34. The lightest powder collects on the outer periphery of the filter cartridges from which it is periodically dislodged by a short burst of reverse air flow as is now conventional in this art.

The air flow characteristics of the booth are balanced so as to insure that the air flow which pulls the oversprayed powder into the collection chamber does not disrupt the uniform application of powder to the web. Powder collected in the collection hoppers 34 is generally pumped by venturi pumps (not shown) from the collection hopper to feed hoppers for recirculation to the guns 14. If the powder is contaminated by too much fiber from the fiber web 16, then the oversprayed powder 34 cannot be directly recirculated to the feed hoppers but must first be collected and purged of the contaminants from the fiber web 16 before being recycled.

In the illustrated embodiment of the booth 10, there are six powder spray guns contained within the booth 10. The number and placement of guns through is a function of the width of the web 16 as well as the quantity of powder to be applied thereto.

Figure 4:
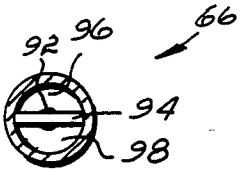
FIG. 4 is a cross sectional view taken on line 4–4 of FIG. 3.
Figure 3:
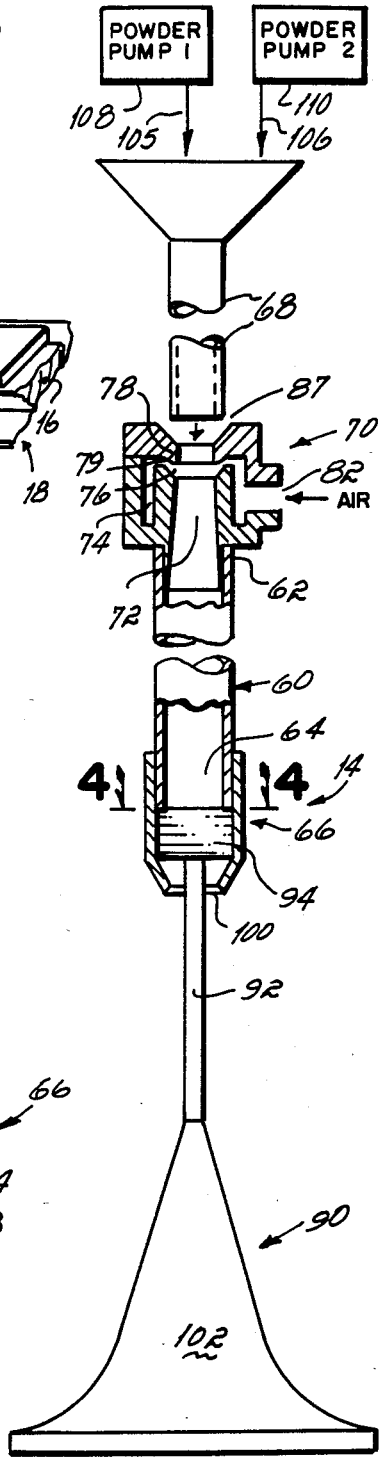
FIG. 3 is a side elevational view partially in cross section, of one powder spray gun employed in the booth of FIG. 1.

As may be seen clearly in FIGS. 3 and 4, each gun 14 comprises a vertically oriented barrel 60 having an inlet end 62 and a discharge end 64. A nozzle 66 is fitted over the discharge end of the barrel. As is explained more fully hereinafter, the nozzle supports a conically shaped deflector suspended from the nozzle 66 of the gun. Air entrained powder is supplied to the inlet end of the gun via powder spray conduits 68. These conduits open into the inlet end of the air flow amplifiers 70 secured to the inlet ends 62 of the barrels 60. Each air flow amplifier 70 has a central nozzle within which there is a central axial bore 72 coaxially aligned with the bore of the barrel 60. Additionally, each amplifier has an annular air flow chamber 74 connected by an annular orifice 76 to the bore 72. An annular lip 78 extends inwardly to the rear of the orifice 76 and has a forwardly sloping surface 79 operable to deflect air flow from the orifice in a forward direction. Compressed air is supplied to the annular chamber 74 via a bore 82 in the amplifier. This compressed air is supplied to the bore 82 from a source of air pressure 84 through a pressure regulator 86. In general, the compressed air is supplied to the amplifier 70 at a pressure on the order of 10–60 psi.

In the use of the gun 14, air entrained powder is supplied to the inlet end of the amplifier 70 via the conduit 68. It is to be noted that there is a substantial gap 87 between the end of the conduit 68 and the entrance to the amplifier 70. Ambient air is drawn through this gap into the entrance or inlet end of the amplifier 70. Compressed air is supplied to the amplifier through the bore 82 to the annular chamber 74 surrounding the bore or throat 72 of the amplifier. This compressed air then passes through the annular orifice 76 at a very high velocity and in the course of passage through the orifice 76, is deflected toward the outlet or discharge end of the gun by the lip 78 on the rearward side of the orifice 76. This high speed air is operable to impact the powder entrained air contained in the bore or throat 72 of the gun and force that powder entrained air at a greater velocity forwardly through the barrel 60 of the gun. Simultaneously, additional ambient air is pulled into the gun through the throat or gap 87 between the inlet end of the amplifier and the discharge end of the conduit 68.

In order to obtain a wide discharge pattern of powder from the gun, a conical deflector 90 is suspended from the nozzle of the gun via a stem 92, the upper end of which terminates in a cross bar 94 secured by the nozzle 66 to the discharge end of the barrel 60. The cross bar 94 is generally rectangular in configuration so that there is a large flow area through channels 96–98 located on opposite sides of the bar 94. Powder, after passing around the bar 94, exits from the gun via an orifice 100 in the nozzle 66. This powder then impacts with the diverging surface 102 of the cone shaped deflector 90 suspended from the nozzle. This deflector causes the relative high velocity powder to be dispensed over a wide area. In practice, by simply varying the pressure at amplifier 70 by means of the regulator 86, the diameter of the pattern of powder dispersed from the gun may be varied anywhere from 18–60 inches. This is a very convenient technique for varying the pattern sprayed from the powder spray gun.

With reference to FIGS. 1 and 3, it will be seen that there are two powder inputs 105, 106 to the powder conduit 68. Each of these inputs 105, 106 is supplied with air entrained powder from an independently adjustable powder pump 108,110 respectively. While it is possible to vary the quantity of powder supplied to the conduit 68 via a simple pump and to change the range of inputs by using different size and capacity powder pumps, it has been found that the use of two independently adjustable powder pumps provides a wider range of adjustability of powder inputs to the conduit 68. In some applications this wider range of variable inputs to the conduit 68 and the separate adjustability of each powder pump enables the system to accommodate varying applications which a single pump might not accommodate. Otherwise expressed, the use of two variable flow powder pumps supplying the conduit 68 facilitate the adjustment of three variables in the system; the flow of powder in pump 108, the flow of powder in pump 110 and the quantity of regulated air pressure supplied to the port 82 of the air amplifier. By adjusting these three variables, the pattern of powder and the quantity of powder dispensed onto the web by each gun may be accurately controlled.

In use of the booth 10, a continuous non-woven fiber web 16 is supplied to the booth via the conveyor 18. In one preferred embodiment, this conveyor is operable to transport the web through the the booth at a speed of 300–600 feet per minute. As the non-woven fiber web passes through the booth, air entrained powder supplied via the conduits 68 to the guns 14 is ejected from the guns at a relatively high velocity sufficient for the powder to pass through air currents associated with the relatively high speed moving web and penetrate the web. The use of the amplifier 70 in conjunction with the gun 14 enables the powder to be dispensed from the gun evenly and at a velocity which is sufficient for the penetration of the web by the powder.

After passage from the booth, the adhesive powder impregnated web is transported by the conveyor to a heating station or oven designated by the numeral 104. At this station 104 the adhesive powder is heated and converted to a molten or at least tacky state. The web is then passed through rollers, as is conventional in this art, so as to compress it and simultaneously lock the fibers of the web into a non-woven fabric.

The conical deflector 90 should preferably be manufactured from electrically conductive material so as to avoid a tribocharge being imparted to the powder. This tribocharge, if applied to the powder, has the effect of disturbing or varying the distribution pattern of powder emitted from the gun. If the deflector 90 is made of electrically conductive material though and is grounded, the pattern dispensed from the gun tends to be stable and not influenced by development of a tribocharge on the powder. In order to ground that deflector, the gun 14 may all be made of metal components and the barrel of the gun grounded so that the grounding lead to the deflector need not interfere with the spray pattern.

Figure 5:
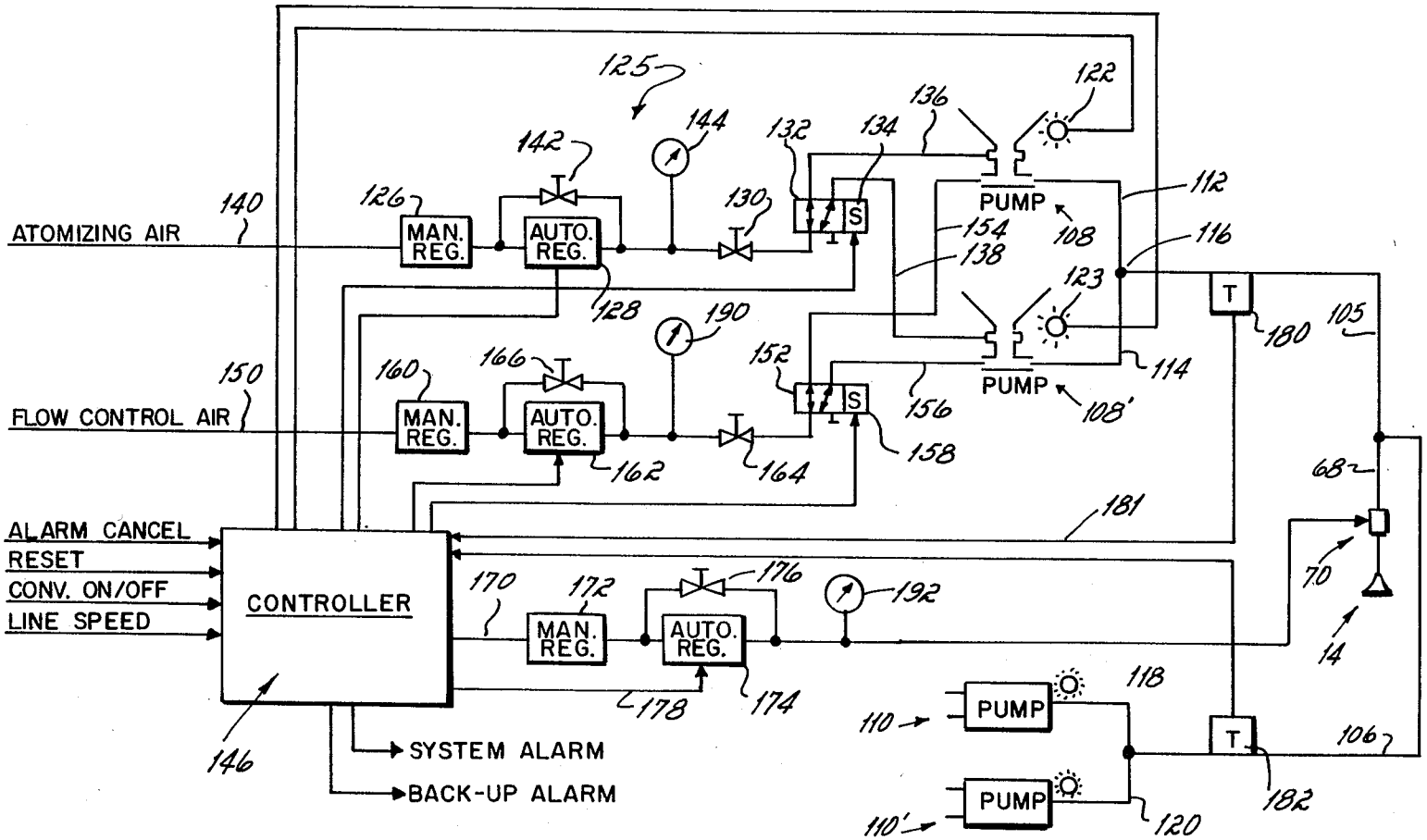
FIG. 5 is a schematic diagram of powder flow control utilized in the practice of this invention.

Referring now to FIG. 5, it will be seen that in a preferred embodiment of this invention, each powder pump 108, 110 is back-stopped by an auxilliary pump 108', 110' connected in parallel with the pumps 108, 110. The parallel connection of the pumps 108, 108' to the line 105 comprises a pair of lines 112, 114, each one of which is connected via a conventional T connection 116 to the line 105. Similarly, the pumps 110, 110' both have their outputs connected via a line 118, 120 to the line 106. As explained hereinafter, the lines 105, 106 are both operative either independently or jointly to supply powder to the powder gun supply conduit 68.

According to the preferred practice of this invention, a control circuit 125 is operable either manually or automatically to switch powder flow from the pump 108 to the back-up pump 108' if flow from the pump 108 should be interrupted for any reason. That control circuit 125 is completely illustrated with respect to the pumps 108, 108'. An identical control circuit is operative to switch flow from the pump 110 to the back-up pump 110' if the flow from the powder pump 110 should be temporarily interrupted. Since the two control circuits are identical, only the circuit 125 associated with the powder pumps 108, 108' is illustrated in FIG. 5. It should be understood that an identical circuit is associated with the pump 110 and its back-up pump 110'.

The powder pumps 108, 108', 110, 110' are all conventional venturi style powder pumps, such as the pump disclosed in U.S. Pat. No. 3,746,254 assigned to the assignee of this application. Such powder pumps are conventionally supplied with two air flow inputs. One input, the so-called flow input, is operative to pull powder into and transport powder from the pump to a dispensing gun. The other air flow input, the so-called atomizing flow, controls the quantity of powder and the air flow mix in the air stream supplied to the dispenser.

The electro-pneumatic control circuit 125 is operative to supply the atomizing air to the pump 108 and 108' through a manually operated regulator 126, through an electrically operated automatic pressure regulator 128, through a manually operated shut-off valve 130, and through a conventional four-way solenoid operated valve 132 to either the pump 108 or the pump 108', depending upon the setting of the solenoid operated valve 132. This four-way valve 132 has two settings controlled by a solenoid 134 of the valve, in one of which settings the atomizing air is connected to the pump 108 via a pneumatic line 136, and in the other of which setting it connects the atomizing air to the back-up pump 108' via a line 138. The manually operated regulating valve 126, the electrically operated pressure regulator valve 128, and the manually operated shut-off valve 130 are all connected in series in the pneumatic line 140 to the input side of the four-way valve 132. Additionally, there is a manually operated shut-off valve 142 connected in parallel around the electrically operated pressure regulator valve 128 so that the electrically operated valve 128 may be manually bypassed in the event of a failure of the pressure regulator 128. There is also a pressure gauge 144 contained in the line 140 between the electrically operated pressure regulator 128 and the manually operated shut-off valve 130. The electrical pressure regulator 128 is controlled from an electronic controller 146. This controller 146 is also operative to control the solenoid 134 of the four-way valve 132, as is explained more fully hereinafter.

The flow control air in pneumatic line 150 is alternatively supplied to pump 108 or the back-up pump 108' via a conventional four-way solenoid operated valve 152. This valve is operative to connect the flow control air to either the pump 108 via a pneumatic line 154 or to the pump 108' via a line 156, depending upon the setting of the valve 152 as determined by the condition of the solenoid 158 associated with the valve. The condition of this solenoid 158, i.e., either energized or de-energized, is controlled from the electronic controller 146 as explained more fully hereinafter. The flow line 150 through which air is supplied to the solenoid 152 includes a series connected manually operated pressure regulator 160, an electrically operated pressure regulator 162, and a manually operated shut-off valve 164. Additionally, there is a manually operated shut-off valve 166 connected in parallel with the electrically operated pressure regulator 162. This manually operated shut-off valve enables the electrically operated pressure regulator 162 to be completely by-passed in the event of a failure of the valve 162.

Air entrained powder flows from the pump 108 or alternatively from the back-up pump 108', through the lines 112 or 114, respectively, to the conduit 105 and from that conduit to the gun 14 via the conduit 68. Simultaneously, air at a regulated pressure is supplied to the air flow amplifier 70 of the gun 14 via a pneumatic line 170. This line includes a manually operated pressure regulator 172 and an electrically operated pressure regulator 174. The electrically operated regulator 174 is connected in parallel with a manually operated bypass valve 176 so that the regulator 174 may be completely bypassed by the shut-off valve 176 in the event of failure of the regulator 174. This electrically operated or so-called automatic regulator 174 is controlled by an electrical signal from the controller 146 via an electrical lead 178.

Contained in each of the powder lines 105 and 106 there is a powder flow measuring transducer 180, 182. These transducers are commercially available particulate flow measuring devices insertable into particulate material flow paths to monitor the quantity of particulate material moving in that path. In a preferred embodiment, the transducers 180, 182 are Model No. 2400 Triboflow Switches manufactured by Auburn International, Inc. of Danvers, Mass. These transducers operate upon the principle of measuring the friction of particles passing over a metal probe contained in the lines 105, 106 to transfer an electrical charge from the moving particles to the probe. This measurable charge or signal is electrically compared with a preset norm and any significant signal deviation triggers a contact closure that sets off an alarm and initiates corrective action as explained more fully hereinafter.

In the operation of the control circuit illustrated in FIG. 5, air flow in lines 140 and 150 to the powder pump 108, as well as air flow to the amplifier 70, are all adjusted to achieve a desired powder flow pattern from the gun 14 for a particular conveyor 18 line speed. To set up the control circuit 125 to achieve a desired powder flow pattern from the gun 14, the manually operated bypass valve 142 around the electrically controlled pressure regulator 128 is fully opened while that pressure regulator is disabled. Similarly, bypass valve 166 ia fully opened around the disabled pressure regulator 162, and the manually operated bypass valve 176 is fully opened around the disabled electrically operated pressure regulator 174. The solenoid operated valves 132, 152 are manually positioned so as to direct the air flow from these valves to the powder pump 108. The manually adjustable pressure regulators 126, 160 and 172 are then adjusted so as to achieve the desired flow pattern from the powder gun 14. The pressure of gauges 144, 190 and 192 are then read to determine the desired pressure in the lines 140, 150, 170 to achieve this desired flow pattern for a particular conveyor line speed. The electrically operated pressure regulators 128, 162, 174 are then adjusted to achieve this same gauge pressure in the lines 140, 150, 170 by fully opening the manually operated pressure regulators 126, 160, 172 and closing the bypass valves 142, 166 and 176. When the electrically operated regulators 128, 162, 174 are properly adjusted so as to obtain this same gauge pressure, those pressure regulator settings are programmed into the controller 146 for a particular line speed. This same procedure is followed to obtain desired settings of the electrically operated regulators 128, 162, 174 for various differing line speeds of the conveyor 18.

After the controller 146 has been programmed by inputting the pressure settings of the electrically operated pressure regulators 128, 162, 174 for all of the desired conveyor 18 line speeds, the system is ready to operate with the powder pumps 108, 110 jointly supplying powder to the powder gun 14. To start the system, a conveyor on/off signal is supplied to the controller. This signal is effective to initiate movement of the conveyor 18 at the programmed speed and to simultaneously initiate air flow in the lines 140, 150, 170 at the programmed air pressure settings for that speed. This results in powder flow from the powder pumps 108, 110 to the gun 14.

In the event that the transducer 180 detects a drop in powder flow below the threshold setting of the transducer, that transducer is operative to signal the controller 146 via the lead 181. This signal causes the controller 146 to switch the settings of the four-way solenoid operated valves 132, 152 so as to direct the air flow from the valves 132, 152 to the back-up pump 108′ via the lines 138 and 156, respectively. This results in the pump 108 being shut down and the pump 108′ being started up. Simultaneously, a back-up alarm signal from the controller 146 is initiated and a light 122 associated with the pump 108 is turned on so as to signal the operator that the flow from the pump 108 has been terminated because of a failure of that pump. During start-up of the back-up pump 108′, input to the controller 146 from the transducer 180 is automatically delayed so that the controller does not switch the control circuit 125 during that delay. After that predetermined delay, which may be on the order of 10 seconds, if the transducer 180 detects a drop in powder flow below the transducer threshold setting, it again signals the controller 146 of this condition. This results in shut-down of the conveyor 18 and initiation of a system alarm signal, as well as a turning on of the light signal 123 associated with the pump 108′. The control system and the conveyor will then remain shut down until the condition is corrected, at which time the operator will input an alarm cancel signal and a reset signal to the controller. These input signals result in re-startup of the system with the pump 108 on line and the pump 108′ disabled until such time as the condition of the transducer 180 triggers a new alarm signal.

The control circuit of FIG. 5 has been illustrated as an open loop circuit for controlling the electrically operated pressure regulators 128, 162, 174. It will readily be appreciated that feed-back, closed loop regulators could be used in place of conventional open loop regulators, if more accurate control of the regulators is desired.

While the powder spray method and apparatus of this invention, including the powder spray gun with its air flow amplifier have been described as being applicable, in the presently preferred embodiment, to the spraying of solid powder adhesives upon non-woven fabric substrates, it will be appreciated that this method and apparatus is useful in the spraying of other powder materials, such as powdered absorbants, for example, upon non-woven fabrics or virtually any moving substrate. Particularly, this gun will find application in the spraying of powders in applications where there is a need to impart substantial velocity to the powder emitted from the gun, as for example to overcome air currents surrounding a moving substrate. Furthermore, while this gun has been described as being applicable to the spraying of powders without the application of an electrostatic charge to the powder, it will be readily apparent to persons skilled in this art that with minor modifications, this invention may be utilized in an electrostatic powder spray gun. Therefore, we do not intend to be limited except by the scope of the following appended claims.

We claim:

1. A powder spray system for applying solid particulate powder to a conveyorized fiber web of material, which system comprises, a powder spray booth having a spray chamber defined at least in part by side walls and a bottom wall, an opening in at least two of said side walls, a conveyor passing through said openings in said side walls, said conveyor being adapted to transport a web of fiber material supported thereon through said booth, powder recovery means including a powder recovery chamber located beneath said bottom wall of said booth, at least one powder spray gun for spraying solid particulate powder upon said web of material, said spray gun comprising, a tubular barrel having an inlet end and a discharge end, means for connecting said inlet end to a source of air entrained powder, a nozzle on the discharge end of said barrel, and air flow amplifier means connected to said barrel for drawing ambient air into said air flow amplifier means and for impacting said air entrained powder with a high velocity air stream in the course of passage of said air entrained powder through said gun.

2. The powder spray system of claim 1 which further includes a powder dispersing deflector adjacent the discharge end of said barrel of said gun, said deflector having a generally conical, diverging surface against which the air entrained powder is directed in the course of being discharged from said gun so as to establish a wide dispersion pattern of said powder.

3. The powder spray system of claim 1 wherein said air flow amplifier means of said spray gun comprises an amplifier nozzle having a central bore axially aligned with said barrel, said amplifier nozzle having an inlet connected to said source of air entrained powder and an outlet open to said barrel, an annular air chamber surrounding said amplifier nozzle, an air inlet into said annular air chamber, means for connecting said air inlet to a source of compressed air, and an annular orifice connecting said annular air chamber to said bore of said amplifier nozzle.

4. The powder spray system of claim 3 wherein said air flow amplifier means has an annular lip surrounding said annular orifice, said lip being operable to deflect air emitted from said orifice toward said discharge end of said barrel.

5. A powder spray system for applying solid particulate powder to a conveyorized web of material, which system comprises, a powder spray booth having a spray chamber defined at least in part by side walls and a bottom wall, an opening in at least two of said side walls, a conveyor passing through said openings in said side walls, said conveyor being adapted to transport a web of material supported thereon through said booth, powder recovery means including a powder recovery chamber located beneath said bottom wall of said booth, at least one powder spray gun for spraying solid particulate powder upon said web of material, first supply means including a first powder pump for supplying air entrained powder to said spray gun, a second supply means including a back-up pump for supplying air entrained powder to said gun in the event of a failure of said first supply means, and control means responsive to detection of a failure of said first supply means to transfer supply of powder to said gun from said first supply means to said second supply means.

6. The powder spray system of claim 5 in which said control means includes a transducer for detecting reduced flow of powder to said gun from said first supply means.

7. The powder spray system of claim 5 in which said control means includes a control instrument responsive to changes in triboelectric effect to determine reduced flow of powder to said gun.

8. A powder spray system for applying particulate powder to a conveyorized web of material, which system comprises, a powder spray booth having a spray chamber defined at least in part by side walls and a bottom wall, an opening in at least two of said side walls, a horizontal conveyor passing through said openings in said side walls, said horizontal conveyor being adapted to transport a web of non-woven fiber material supported thereon through said booth, powder recovery means including a powder recovery chamber located beneath said bottom wall of said booth, and at least one powder spray gun located above said conveyor for spraying solid particulate powder downwardly upon the top of said web of material, said spray gun comprising, a tubular barrel having an inlet end and a discharge end, means for connecting said inlet end to a source of air entrained powder, a nozzle on the discharge end of said barrel, and air flow amplifier means connected to said barrel, said air flow amplifier means being operable to draw ambient air into said air flow amplifier and to impact said air entrained powder with a high velocity air stream in the course of passage of said air entrained powder through said gun.

9. The powder spray system of claim 8 which further includes a generally conical powder dispersing deflector adjacent the discharge end of said barrel of said gun, said deflector having a diverging surface against which the air entrained powder is directed in the course of being discharged from said gun so as to establish a wide dispersion pattern of said powder.

10. The powder spray system of claim 8 wherein said means for connecting said inlet end of said barrel to a source of air entrained powder includes at least two independently operable powder pumps and means connecting each of said powder pumps to said inlet end of said barrel.

11. The powder spray system of claim 8 which further comprises first supply means including a first powder pump for supplying air entrained powder to said spray gun, a second supply means including a back-up pump for supplying air entrained powder to said gun in the event of a failure of said first supply means, and control means responsive to detection of a failure of said first supply means to transfer supply of powder to said gun from said first supply means to said second supply means.

12. The powder spray system of claim 11 in which said control means includes a transducer for detecting reduced flow of powder to said gun from said first supply means.

13. The powder spray system of claim 8 in which said control means includes a control instrument responsive to changes in triboeletric effect to determine reduced flow of powder to said gun.

14. A powder spray system for applying solid particulate powder to a target substrate, which system comprises, a powder spray booth having a spray chamber defined at least in part by side walls and a bottom wall, an opening in at least two of said side walls, a conveyor passing through said openings in said side walls, said conveyor being adapted to transport a target substrate supported thereon through said booth, powder recovery means including a powder recovery chamber located adjacent said booth for recovering oversprayed powder from said booth, at least one powder spray gun for spraying solid particulate powder upon said target substrate, first supply means including a first powder pump for supplying air entrained powder to said spray gun, second supply means including a second back-up pump for supplying air entrained powder to said gun in the event of a failure of said first supply means, and control means responsive to detection of a failure of said first supply means to transfer supply of powder to said gun from said first supply means to said second supply means.

15. The powder spray system of claim 14 in which said control means includes a transducer for detecting reduced flow of powder to said gun from said first supply means.

16. The powder spray system of claim 14 in which said control means includes a control instrument responsive to changes in triboelectric effect to determine reduced flow of powder to said gun.

17. The powder spray system of claim 14 wherein each of said first and second supply means includes a source of atomizing air and a source of flow control air, said source of atomizing air being selectively connectable to said first and second powder pumps through a series connected manual pressure regulator, an automatic pressure regulator and a two position flow control valve, and said source of flow control air being selectively connectable to said first and second powder pumps through a series connected manual pressure regulator, an automatic pressure regulator, and a two position flow control valve.

18. The powder spray system of claim 17 which further includes a pair of manual bypass valves, one of said pair of manual bypass valves being connected in parallel with each of said automatic pressure regulators.

19. The powder spray system of claim 18 which further includes a pair of pressure gauges and a pair of manually operable shut-off valves, one of said pair of pressure gauges and one of said pair of manually operable shut-off valves being connected in series between each of said automatic pressure regulators and said two position flow control valves.

20. The powder spray system of claim 17 which further comprises controller means, said controller means being connected to each of said automatic pressure regulators and operable to control the pressure setting of said automatic pressure regulators.

21. A powder spray system for applying solid particulate powder to a target substrate, which system comprises, a powder spray booth having a spray chamber defined at least in part by side walls and a bottom wall, an opening in at least two of said side walls, a conveyor passing through said opening in said side walls, said conveyor being adapted to transport a target substrate thereon through said booth, powder recovery means including a powder recovery chamber located adjacent said booth for recovering over-sprayed powder from said booth, at least one powder spray gun for spraying solid particulate powder upon said target substrate, powder supply means including a powder pump for supplying air entrained powder to said spray gun, air flow amplifier means and a source of high velocity air flow to said air flow amplifier means, said air flow amplifier means being operable to draw ambient air into said air flow amplifier means and to impact said air entrained powder with a high velocity air stream from said source of high velocity air flow in the course of passage of said air entrained powder through said powder spray gun, a source of atomizing air and a source of flow control air, said source of atomizing air being connected to said powder pump through a series connected manual pressure regulator, an automatic pressure regulator and a two position flow control valve, said source of flow control air being connected to said powder pump through a series connected manual pressure regulator, an automatic pressure regulator, and a two position flow control valve, and said source of high velocity air flow to said air flow amplifier means being connected to said air flow amplifier means through a series connected manual pressure regulator, and an automatic pressure regulator.

22. The powder spray system of claim 21 which further includes three manual bypass valves, one of said three manual bypass valves being connected in parallel with each of said automatic pressure regulators.

23. The powder spray system of claim 22 which further includes two pressure gauges and two manually operable shut-off valves, one of said two pressure gauges and one of said two manually operable shut-off valves being connected in series between each of said automatic pressure regulators and said two position flow control valve.

24. The powder spray system of claim 21 which further comprises controller means, said controller means being connected to each of said automatic pressure regulators and operable to independently control the pressure setting of said automatic pressure regulators.

25. A powder spray system for applying solid particulate powder to a target substrate, which system comprises, at least one powder spray gun for spraying solid particulate powder upon said target substrate, powder supply means including a powder pump for supplying air entrained powder to said spraying, air flow amplifier means, a source of a high velocity air flow connected to said air flow amplifier means, said air flow amplifier means being operable to draw ambient air into said air flow amplifier and to impact said air entrained powder with a high velocity air stream in the course of passage of said air entrained powder through said powder spray gun, a source of atomizing air and a source of flow control air connected to said powder pump, said source of atomizing air being connected to said powder pump through a pressure regulating means, said source of flow control air being connected to said powder pump through a pressure regulating means, and said source of high velocity air flow to said air flow amplifier means being connected to said air flow amplifier means through a pressure regulating means.

26. The powder spray system of claim 25 further comprising controller means, said controller means being connected to each of said pressure regulating means of said source of atomizing air, said source of flow control air, and said source of high velocity air flow to said air flow amplifier means and being operable to independently control the pressure settings of each of these pressure regulating means.

27. The powder spray system of claim 25 wherein said source of atomizing air is connected to said powder pump through a series connected manual pressure regulator, an automatic pressure regulator, and a two position flow control valve, said source of flow control air being connected to said powder pump through a series connected manual pressure regulator, an automatic pressure regulator and a two position flow control valve, and said source of high velocity air flow to said air flow amplifier means being connected to said air flow amplifier means through a series connected manual pressure regulator, and an automatic pressure regulator.

28. The powder spray system of claim 27 which further includes three manual bypass valves, one of said three manual bypass valves being connected in parallel with each of said automatic pressure regulators.

29. A powder spray system for applying solid particulate powder to a target substrate, which system comprises, at least one powder spray gun for spraying solid particulate powder upon said target substrate, first supply means including a first powder pump for supplying air entrained powder to said spray gun, second supply means including a back-up pump for supplying air entrained powder to said gun in the event of a failure of said first supply means, and control means responsive to detection of a failure of said first supply means to transfer supply of powder to said gun from said first supply means to said second supply means.

30. The powder spray system of claim 29 in which said control means includes a transducer for detecting reduced flow of powder to said gun from said first supply means.

31. The powder spray system of claim 29 in which said control means includes a control instrument responsive to changes in triboelectric effect to determine reduced flow of powder to said gun.

* * * * *

UNITED STATES PATENT AND TRADEMARK OFFICE

CERTIFICATE OF CORRECTION

PATENT NO. : 4,561,380

DATED : December 31, 1985

INVENTOR(S) : Douglas C. Mulder et al.

It is certified that error appears in the above-identified patent and that said Letters Patent is hereby corrected as shown below:

Claim 25, column 14, line 48, "spraying" should read -- spray gun --.

Signed and Sealed this

*Thirtieth* Day of *September 1986*

[SEAL]

*Attest:*

DONALD J. QUIGG

*Attesting Officer*

*Commissioner of Patents and Trademarks*